US005424042A

United States Patent [19]

Mason et al.

[11] Patent Number: 5,424,042

[45] Date of Patent: Jun. 13, 1995

[54] APPARATUS AND METHOD FOR PROCESSING WASTES

[76] Inventors: J. Bradley Mason, 10201 West Ct., Pasco, Wash. 99301; R. Paul Denault, 227 Ripley Station, Columbia, S.C. 29212; Mark A. Hall, 310 Green Tree Ct., #4, Richland, Wash. 99352; Maurice P. Carson, 1148 Indian Summer Point, Chapin, S.C. 29036

[21] Appl. No.: 121,224

[22] Filed: Sep. 13, 1993

[51] Int. Cl.[6] ..... G21C 19/00

[52] U.S. Cl. ..... 422/159; 422/184; 588/252; 588/256; 588/900

[58] Field of Search ..... 422/159, 184; 588/252, 588/256, 900; 241/DIG. 38

[56] References Cited

U.S. PATENT DOCUMENTS

| | | | |
|---|---|---|---|
| 3,520,805 | 7/1970 | Ryan | 210/32 |
| 3,773,177 | 11/1973 | Queiser et al. | 210/68 |
| 4,415,457 | 11/1983 | Shirosaki et al. | 210/682 |
| 4,518,507 | 5/1985 | Conner | 210/747 |
| 4,540,490 | 9/1985 | Shibata et al. | 210/323.2 |
| 4,666,490 | 5/1987 | Drake | 588/256 |
| 4,687,373 | 8/1987 | Falk et al. | 588/256 |
| 4,701,222 | 10/1987 | Kobayashi et al. | 588/256 |
| 4,737,316 | 4/1988 | Macedo et al. | 252/633 |
| 4,925,566 | 5/1990 | Bardot et al. | 210/651 |
| 5,158,674 | 10/1992 | Kikuchi et al. | 210/195 |
| 5,177,305 | 1/1993 | Pichat | 588/252 |
| 5,234,498 | 8/1993 | Graves, Jr. | 588/256 |
| 5,277,846 | 1/1994 | Tanari | 588/256 |
| 5,280,149 | 1/1994 | Schneider et al. | 588/256 |

*Primary Examiner*—Timothy M. McMahon
*Attorney, Agent, or Firm*—Michael A. Mann

[57] ABSTRACT

A system for vitrifying all kinds of waste, including toxic, industrial, household and radioactive wastes such as those generated by nuclear power plants, including dry active wastes, ion exchange resins and aqueous wastes wherein the wastes are conditioned, blended, mixed with glass formers and then fed into a heating chamber where organic constituents of the waste are burned and inorganic constituents are melted with the glass formers to form a waste glass. The aqueous waste may be conditioned by concentrating its solids content up to as much as 90% solids. The dry active waste is conditioned, and mixed to some extent by shredders. The conditioned waste may be blended to achieve a uniform heat energy content of the waste being fed into the heating chamber. The heating chamber has a larger combustion zone to handle the greater amount of organic waste than would be expected in conventional melters, and a melting zone having a replaceable crucible and liner. The combustion takes place in an oxygen-enriched atmosphere formed by a mixture of oxygen enriched gas and including a portion of the off-gas if desired, which is still enriched following combustion. Particulate removed from the off-gas is returned to the melting chamber or is solidified by the liquid/solids blender/dryer. The molten waste glass is cooled and put into a form suitable for storage, such as a glass frit, globules, or glass monoliths.

27 Claims, 3 Drawing Sheets

64
66
62
72
68
54
58
76
78
74
56
2A
22
98
94
96
108
104
84
86
26
102
87
88
92
107
106
112
114
123
124
118
122
116
128
132
126

APPARATUS AND METHOD FOR PROCESSING WASTES

BACKGROUND OF THE INVENTION

1. Field of the Invention

The present invention relates to methods and devices for processing waste, especially radioactive, toxic, industrial and household waste generated from factories, nuclear power plants, hospitals, institutions and the like. More particularly, the present invention relates to the treatment of wastes from solid and liquid, including both aqueous and nonaqueous, wastes streams to form a stable, final glass waste product.

2. Discussion of Background

Economic and regulatory factors require nuclear power utilities and other generators of radioactive waste to develop and evaluate new technologies and methodologies for improving safety and reducing the costs of operations. Also, reducing the volume of waste generated and improving the stability of the disposed waste is of prime interest within our increasingly environmental-conscious society. Improvements in waste processing operations and procedures can significantly reduce waste management costs, waste volume, and the concern associated with storage and permanent disposal of the final waste.

Additionally, existing legislation may require all power plants to store on-site the waste each plant generates if centralized storage or disposal facilities are not available. Thus, improvements in waste processing systems should include not only significant reductions in the volume of the final waste form but also the capability of identifying and separating the waste from each generator so that waste can be returned to the generator for storage.

Nuclear power plants, which produce much of the radioactive waste, generate a plurality of waste types typically broken down into three classifications: "dry active waste" (DAW), "wet waste" or ion exchange resins and "liquid waste." Dry active waste includes paper, wood, metal scraps, plastic sheeting, clothing and the like. Currently, dry active waste is processed by low and high density compaction, with compaction ratios of approximately 2:1 to 6:1, depending on its particular composition and the force exerted. Some forms of DAW are currently incinerated with a volume reduction of approximately 50:1.

Wet waste includes ion exchange resins, typically in granular or powdered form. Wet waste is currently processed by dewatering (drying) to take out interstitial or free water. Usually, drying does not necessarily include removing water from the resin bead itself.

Liquid waste includes organic waste (oils, chemical solutions), which is combustible, and inorganic waste such as aqueous wastes and sludges, inorganic acids, and solutions of boron, NaOH and the like. Organic wastes are currently incinerated or stabilized. Inorganic waste, mostly comprised of aqueous salt solutions, is currently being processed by demineralization, ion exchange, membrane technology and evaporation, all of which are well known in the art of waste processing. Also, aqueous waste is processed by evaporator/dryers to yield concentrated and/or dried, solid waste.

Numerous processing methods are known for treating and processing waste generated from power plants and the like, including radioactive wastes generated from nuclear power plants. For example, Bardot et al, in U.S. Pat. No. 4,925,566, describe the use of ultrafiltration, hyperfiltration and demineralization for radioactive liquid elements.

Also, the notion of ion exchange and the use of ion exchange resins for radioactive waste processing is well known, as described in U.S. Pat. Nos. 3,520,805, issued to Ryan, and 4,415,457, issued to Shirosaki et al. Ryan describes filtration through ion exchange resin-coated fibers. Shirosaki et al absorb ions in power plant filter backwash onto an ion exchange resin.

Several U.S. patents combine additional waste processing methods with the use of ion exchange resins. These patents include U.S. Pat. Nos. 3,773,177, issued to Queiser et al, and 5,158,674, issued to Kikuchi et al. Queiser et al follow the use of ion exchange resins with filtration and drying processes. Similarly, Kikuchi et al treat radioactive liquid wastes using membranes to concentrate the wastes, filtration of oils using active silica, and then incineration of the flammable solids on the active silica. Also, in Macedo et al (U.S. Pat. No. 4,737,316), contaminated liquid is purified by passing it through an ion exchange resin then "sintering" the resin.

Another procedure known for use in processing radioactive waste is vitrification, that is, the incorporation of the inorganic portion of the waste into a stable, glass matrix having radioactive elements as part of the glass structure. Vitrification has been studied for decades as a way of stabilizing high level radioactive waste, and a number of patents exist that relate thereto. However, more recently, vitrification has been used with other types of radioactive wastes. For instance, Macedo et al (U.S. Pat. No. 4,737,316) state in their specification that it is well known to form borosilicate glass from the processing of ion exchange resin and glass frit.

Incineration is used to reduce the volume of radioactive waste but, because the ash produced from combusting the waste contains radioactive material, further processing of the ash is required to stabilize it.

Despite the number of waste processing procedures known for use with hazardous or radioactive wastes from power plants and the like, there exists a need for an effective process system that significantly reduces the volume of all types of waste from nuclear power plants, and produces a stable, final waste product that is easily manageable for storage, transporting, disposal and the like.

SUMMARY OF THE INVENTION

According to its major aspects and broadly stated, the present invention is a device and method for processing all kinds of waste including toxic, industrial, household and the like, but especially the three main radioactive waste streams generated by power plants, hospitals and the like. In particular, it is a system applicable for processing all kinds of waste, especially radioactive waste, both solid and liquid forms, including vitrification to immobilize radioisotopes in a stable, final waste product. This system has several subsystems, including a feed conditioning subsystem for conditioning each type of waste, a feed preparation subsystem for blending all of the waste types, a feed melter chamber with an upper thermal zone and a lower melting zone, a glass handling subsystem for packaging and storing the final product, and an off-gas cleaning and control subsystem.

The conditioning subsystem conditions the waste feed by shredding tile dry active waste, drying tile bead and powdered ion exchange resins, and concentrating the aqueous waste. The conditioned waste can then be blended in tile feed preparation subsystem to produce a waste feed having a consistent BTU value per unit mass when combusted and incorporated with glass formers into the waste if necessary. In the feed melter chamber, combustible, organic waste is oxidized and noncombustible waste and decomposition products are incorporated into the melted glass formers. The molten glass is cooled and put into a suitable container. The particulate carried in the off-gas resulting from destruction of the waste is captured in the off-gas cleaning and control subsystem and can be returned to the feed melter chamber to be incorporated into the melt or can be solidified with a blender-dryer in the feed conditioning subsystem.

The first component of the feed conditioning subsystem is a feed inventory and handling conveyor and shredder for shredding the dry active wastes. Shredding the dry active wastes promotes better blending of dry active wastes with the other waste types, reduces the size to enable faster and more efficient burning and minimizes potential damage to the melter from large, heavy objects.

The second component of the feed conditioning subsystem involves means for drying the resin wastes by removing the interstitial or free water from among the granular and powdered ion exchange resins. Such resin drying can be effected by a number of known methods, including the method disclosed in U.S. Pat. No. 4,952,339, which is commonly assigned.

The third component of the feed conditioning subsystem involves means for concentrating aqueous wastes by separating some of the liquid from the dissolved salts and particulate suspended in it. Methods for reducing the liquid volume of aqueous wastes include sophisticated filtering systems based on membrane technology such as microfiltration and hyperfiltration (also known as reverse osmosis). Also, drying systems using a rotary blender-dryer to evaporate water, can be used for liquid volume reduction of aqueous wastes.

The feed preparation subsystem mixes conditioned DAW, dried resins and concentrated aqueous waste with glass forming materials prior to feeding them into the reciter chamber. Wastes can be processed separately or as a blended feed depending upon radiation dose levels, BTU value or other criteria. Resin drying and concentrating of the aqueous wastes takes place typically at the generator's facility, but the shredding of DAW generally takes place away from the generator's facility. Accordingly, shredders can be used to assist in mixing the waste types and serve the two functions of blending and shredding. Also, depending on the particular constituency of the waste types, some of the waste can be fed directly into the melter chamber along with glass formers without blending. It is desirable to deliver a waste feed to the melter chamber that has a consistent BTU and radioactivity content when combusted to improve the operational efficiency of the melter chamber operation and ultimately produce a highly stable and more uniform final glass product. Shredders can include a low speed shear type, a high speed impact type, as well as rotary conveyor screws.

The melter chamber, which has an upper thermal zone and a lower melting zone, receives the waste feed from the feed preparation subsystem. The thermal zone oxidizes the organic constituents within the waste feed in converting the organic and inorganic constituents into ash and off-gas. The melting zone uses a heated vessel to controllably melt the glass formers and combine them with the ash and the noncombustible material.

The melting zone of the melter chamber is connected to the glass handling subsystem. In the preferred embodiment, the glass handling subsystem cools the molten glass received from the melter and packages it accordingly. Alternatively, the molten glass may be cooled as it moves along a conveyor that causes the molten glass to form globules (marbles) as it cools for ease in recycling glass in the future or by a fluid cooled bath prior to being packaged in the appropriate containers.

The thermal zone of the melter chamber is connected to the off-gas cleaning and control subsystem. The off-gas cleaning and control subsystem captures a portion of the off-gas for recycling to the melter chamber and scrubs the remainder of the off-gas for stack emitting.

An important feature of the present invention is the combination of aqueous waste streams and vitrification. Although vitrification of radioactive waste is known, the feeding of partially concentrated aqueous wastes, wastes that are less than 20% concentrated, is believed to be new.

Another important feature of the present invention is the waste feed melter chamber. The melter chamber is dual purpose. Some conventional melters allow for some destruction of organics but are not designed or intended for significant destruction. The present melter is so designed in order to accommodate the large fraction of DAW and organic liquid wastes entering the melter.

Furthermore, the heated vessel portion of the melter chamber is designed to be easily replaceable so that processing is not interrupted for long periods of time while the entire melter chamber is replaced. The present invention features a disconnect mechanism that detaches the heating vessel from the melting zone. The heating vessel can be quickly and easily interchanged to optimize waste processing or refractory replacement. All melter types can be adapted for use with the disconnect system, including: refractory lined, Joule heated electrode melters; induction-heated cold wall crucible melters; induction-heated warm wall crucible melters; in-can melters having induction or resistance heating; and slagging cold wall melters.

Finally, unlike conventional melters, the heated vessel in the preferred embodiment of the present invention is heated by induction rather than by Joule heater electrodes. An inductively heated melter is simpler in design and easier to maintain and can heat to higher temperatures than one heated with electrodes. In addition, most melters operate in a reducing mode that can generate liquid metals that are not readily incorporated into a glass matrix. Also, a hotter oxidizing melter is better suited for waste having a high metal content because it further reduces the amount liquid metal that forms in the melt.

Induction heating allows more efficient, uniform and controlled heating and melting rates than conventional electrode melter chambers. Also, direct heating is possible since the induction field directly heats the melter liner, metal and glass matrix. As a result, any undissolved metal remaining in the melt chamber can be melted or consumed by a short heatup to a higher temperature, thereby minimizing refractory temperature during normal operations and eliminating electrode loss common in Joule heated melters. Also, induction melting has inherent stirring characteristics that provide better glass homogeneity.

The depth of penetration of the induction field can be increased by selection of the induction coil power supply frequency. Cold or warm wall induction heated crucibles are preferred, as glass can significantly corrode (dissolve) typical suscepting crucible materials such as silicon carbide, whereas a warm or cold wall crucible uses a solidified layer of glass against the inner wall for optimum corrosion protection.

Still another feature of the present invention is the system for feeding of enriched oxygen into the melter chamber. Most melters operate in reducing mode, which can generate liquid materials that are not readily incorporated into the glass matrix. The present invention feeds an air/oxygen mixture into the melter chamber to aid in thermal oxidation and control. Also, the use of an enriched air/oxygen improves combustion kinetics, allows higher temperature operation and greatly reduces off-gas volumes.

The improved oxygen atmosphere in the melter of the present invention enhances the production of glass soluble metal oxides instead of liquid metals that can cause catastrophic failure of most melters. Since the air/oxygen mixture has enriched oxygen, approximately half of this feed can be returned to the melter chamber from the off-gas if desired. The recycled gas preheats the fresh oxygen/air mixture but does not dilute the amount of oxygen available for oxidation below appropriate levels.

Carbon dioxide and nitrogen in the recycle gas can be removed using conventional cyrogenic or adsorption technology to provide oxygen-enriched recycle gas. The major purpose of recycle gas is to control or moderate melter temperatures and to allow reuse of excess oxygen in the off-gas.

Yet another feature is the use of off-gas cleaning and pollution control components within the waste processing system. The off-gas cleaning and pollution control components collectively remove radioactive or undesirable particulate and acid gases from off-gas resulting from combustion during waste processing. The advantage of this feature is that harmful pollutants are removed from the off-gas, thus producing cleaner stack emissions.

Another feature is the use of a liquid-cooled conveyor in an alternative embodiment of the present invention. The liquid-cooled metal belt conveyor rapidly transports and cools the glass moving from the melter chamber to the storage containers. The conveyor's movement and rapid cooling cause the molten glass to form globules (marbles) that are eventually placed in the storage containers.

Another feature of the present invention is the shredding device for shredding dry active waste and, when desired, mixing DAW with ion exchange resins and concentrated liquid waste. The shredder makes the DAW easier to mix and increases it combustion efficiency.

Other features and advantages of the present invention will be apparent to those skilled in the art from a careful reading of the Detailed Description of a Preferred Embodiment presented below and accompanied by the drawings.

FIG. *2a* is a cross-sectional schematic view of the feed conditioning and waste preparation subsystems taken along the line *2a—2a* of FIG. *2b;*

Figure 1:
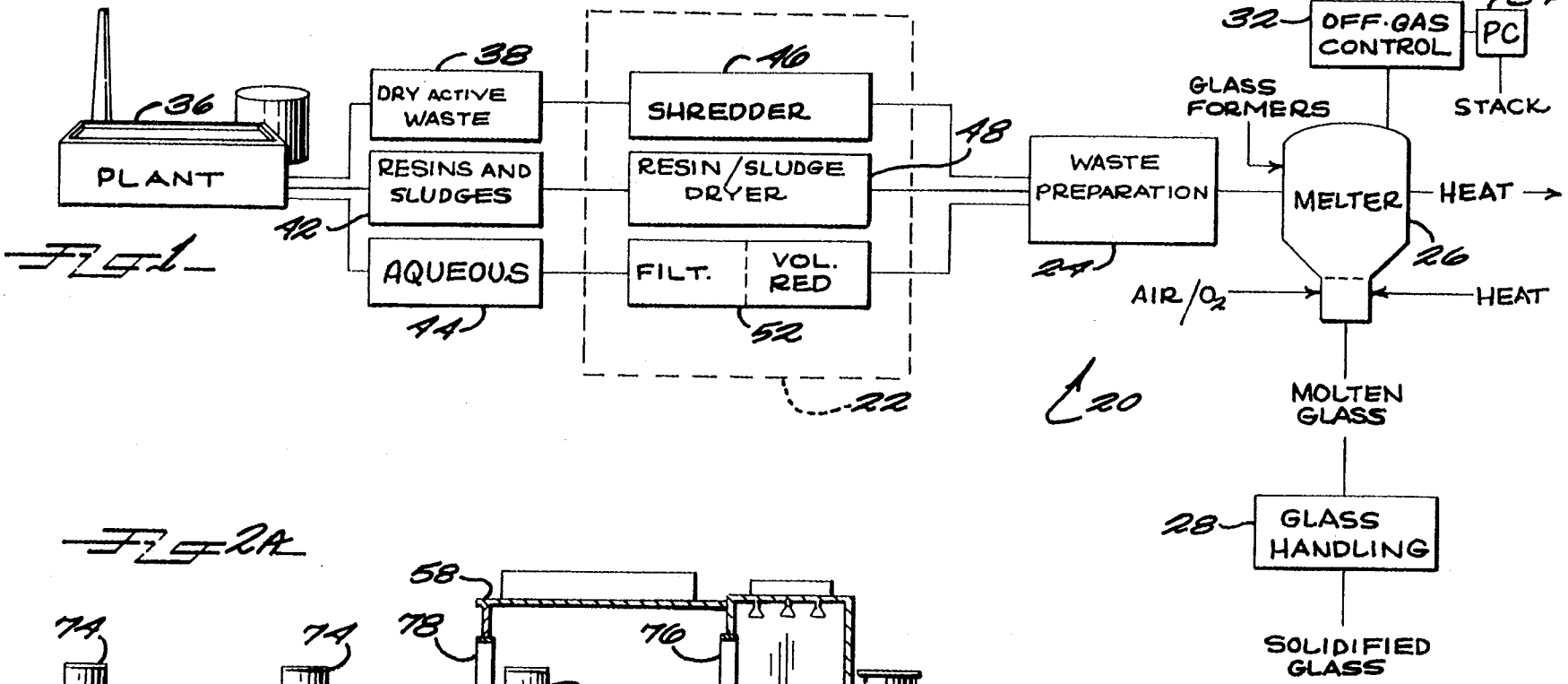
FIG. 1 is a diagrammatic view of a waste processing system according to a preferred embodiment of the present invention.
Figure 2A:
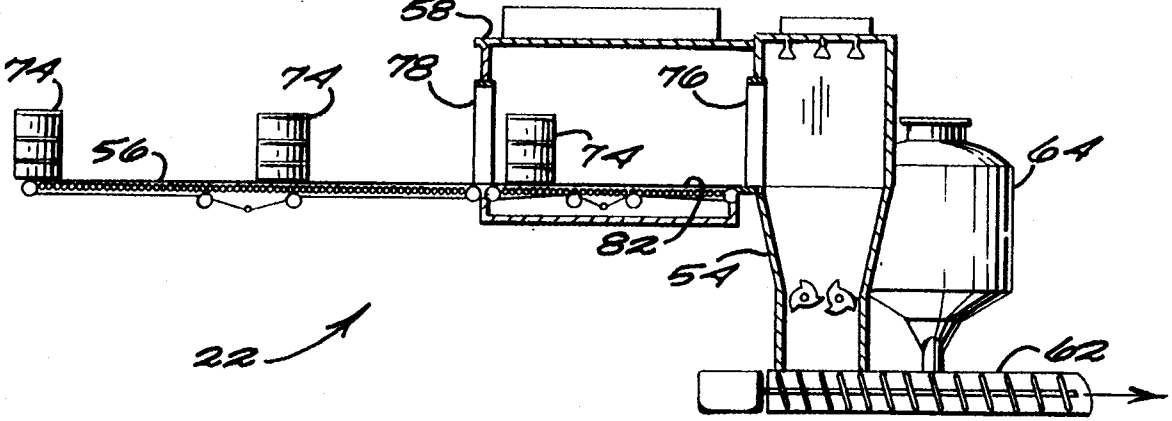
Figures 2B, 3, 4:
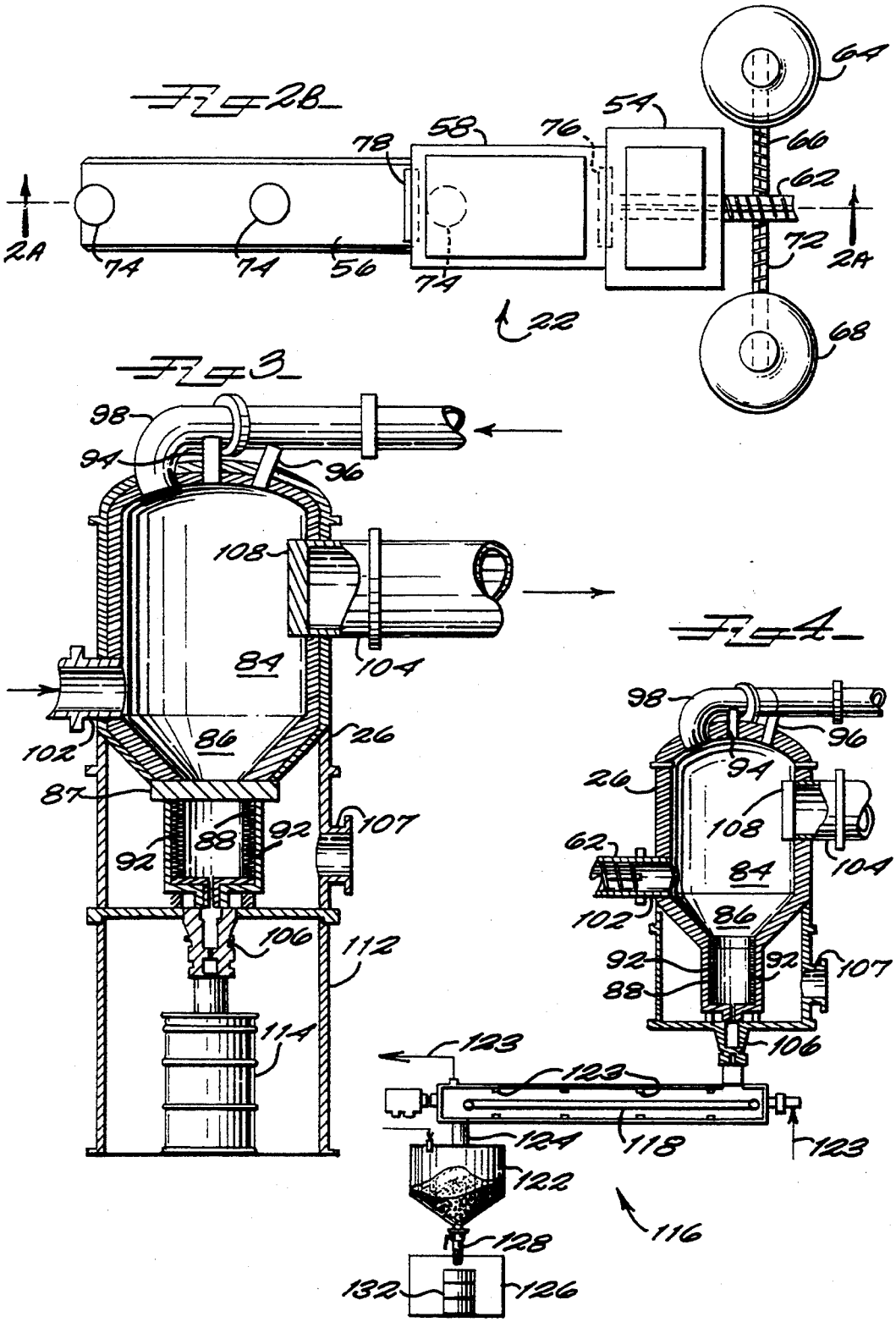

FIG. *2b* is a top, schematic view of the feed conditioning and waste preparation subsystems of the waste processing system of FIG. 1;

FIG. 3 is a partial cross-sectional view of the feed melter chamber and glass handling subsystem of the waste processing system of FIG. 1 according to a preferred embodiment of the present invention;

FIG. 4 is a partial cross-sectional view of the feed melter chamber and glass handling subsystem of the waste processing system of FIG. 1 according to an alternate embodiment of the present invention;

FIG. *5a* is a top view of the off-gas cleaning and control subsystem of the waste processing system of FIG. 1; and FIG. *5b* is a side, partial cross-sectional view of the off-gas cleaning and control subsystem of the waste processing system of FIG. 1.

DETAILED DESCRIPTION OF A PREFERRED EMBODIMENT

In the following description similar components are referred to by the same reference numeral in order to simplify the understanding of the sequential aspect of the drawings.

Referring now to FIG. 1, the radioactive waste processing system 20 in its preferred embodiment is comprised of a number of subsystems: a feed conditioning subsystem 22, a waste preparation subsystem 24, a melting/combustion subsystem having a two-zone melter chamber 26, a glass handling subsystem 28, and an off-gas cleaning and control subsystem having an off-gas control component 32 and a pollution control component 34.

Radioactive waste from a plant 36, such as a nuclear power plant but which could be a hospital or other radioactive waste generator, can usually be characterized as coming from one of three main waste streams or types of waste: dry active waste (DAW) 38, ion exchange resin and wet waste or sludge 42, and liquid waste having organics and inorganics, a substantial portion of which is aqueous waste 44.

Prior to any vitrification activity, each type of waste is preferably conditioned before it is blended with the other wastes from that generator and glass formers for feeding into melter chamber 26. The goal of waste preparation is to form a waste feed that has a uniform BTU content through blending, drying or size reduction. The first type of waste, DAW 38, is typically comprised of wooden boards and metal fragments, low level protective clothing such as rubber or plastic booties and gloves, paper and the like, and is usually packaged for handling in the form of bales, drums or plastic bags containing semi-compacted or non-compacted DAW 38.

DAW 38 is conditioned preferably by shredding with a shredder 46 (discussed more fully below) to reduce the size of pieces of DAW 38. Shredding DAW 38 with shredder 46 allows DAW 38 to blend more easily with the various constituents of DAW and the wastes from the other waste streams, as well as to increase surface area and oxidation kinetics in the melter. Instead of compacting at the generator's facility, DAW 38 can simply be packed into drums, bales and similar containers for transporting to waste preparation subsystem 24, which can be on-site but is preferably part of a centralized, waste processing facility located off-site.

The resins in resins and sludges 42 that are generated by plant 36 typically exist in granular or powdered form and are usually introduced into processing system 20 in any packaging that is desirable for efficient handling and transport. The sludges in resins and sludges 42 are usually floor drain tank bottoms and storage tank bottoms. Resins and sludges 42 are conditioned preferably by dewatering (drying) to remove the slurry and interstitial water, or "free" water between resin beads. Such dewatering does not necessarily include significant removal of water in the resin beads themselves.

Preferably, resins and sludges 42 are dewatered using a resin dryer 48, which can be any suitable dryer that removes the free or standing water from resins and sludges 42 efficiently. Most preferably, resin dryer 48 is of the kind taught in commonly-assigned U.S. Pat. No. 4,952,339, whose disclosure is incorporated herein by reference. Once the interstitial water has been removed from resins and sludges 42 using the necessary resin dryer 48, resins and sludges 42 are stored in containers suitable for transporting in shielded casks to waste preparation subsystem 24.

The remaining waste is generally referred to as liquid waste, however, it consists predominately of aqueous waste 44, and to a lesser extent, of organic liquid waste. Constituents of liquid waste other than aqueous waste 44 include combustible organics, lube oil, antifreeze, inorganic acids and salts, boron and the like, and make up a very small proportion of the liquid waste compared to the proportion of aqueous waste 44. Conditioning of aqueous waste 44 usually occurs through concentration processes involving filtration technologies and/or liquid volume reduction, both of which are shown as 52.

Filtration/liquid volume reducer 52 can be comprised of any desirable combination of filters, evaporators, dryers, and the like as needed. Preferably, filtration/liquid volume reducer 52 comprises prefiltration and microfiltration membranes, reverse osmosis (hyperfiltration) membranes, and an evaporator/concentrator tank followed by a vacuum dryer.

All aspects of filtering and liquid volume reduction used in filtration/liquid volume reducer 52 can be accomplished using selective microfiltration and reverse osmosis with aqueous volume reduction to treat streams of liquid or aqueous waste 44. These technologies are known individually but their combination with vitrification is new and cost-effective in concentrating aqueous waste 44, and particularly aqueous waste 44 having a high conductivity, such as wastes from laundries and floor and equipment drains. Also, these technologies generate much less waste volume than conventional filtration.

The initial stage of concentration uses reverse osmosis whereby water is forced from a more concentrated solution through a selective or semipermeable membrane into a less concentrated solution by exerting high pressure on the concentrated solution. Particulate matter and dissolved material in the concentrated stream do not pass through the selective membrane; only clean water passes through the selective membrane.

Most of the selective membranes used for reverse osmosis are made from either cellulose diacetate and cellulose triacetate blends, aramid hollow fiber, or are based on polyamide chemistry. Typically, the membranes have pore sizes less than 10° Angstroms ($10^{-7}$ cm) and can retain organic materials in the range of 100 to 200 molecular weight.

Preferably, aqueous waste 44 is pretreated using conventional filtration, microfiltration, pH adjustments, surfactants and the like prior to using reverse osmosis processes. Pretreatment is often necessary to prevent membrane fouling caused by material in suspension or low solubility salts in aqueous waste 44 that precipitate upon concentration.

Microfiltration membranes are similar to membranes used for reverse osmosis except that the pores on microfiltration membranes are significantly larger, usually between 400° and 10,000° Angstroms. Obviously, the degree and quantity of separation depends on the respective pore sizes and the particular contents of aqueous waste 44 being filtered. However, typical microfiltration is suited to remove organics (oils and the like) and colloidal material from various types of aqueous waste 44.

The final stage of the conditioning of aqueous waste further separates the liquid portion of aqueous waste 44 from the solid residue while either reusing or discharging the clean water. This system is suitable for processing aqueous waste 44 having both dissolved and suspended solids, as well as sludges. The system uses a blender/dryer to evaporate water from aqueous waste 44, resulting in concentrated aqueous waste 44 having approximately 5–90% by volume solids.

Depending on the particular initial concentration of waste 44, the system can be used without prior filtration processes such as those previously described. However, although the system is capable of handling aqueous waste 44 having very low solids, its efficiency improves when prior filtration processes have been performed. Preferably, reverse osmosis processes are included with the blender/dryer system in a portable, multiple skid-mounted assembly for easy handling. In this manner, the prefiltration and microfiltration units preferably comprise the first skid, while the reverse osmosis component is mounted on the second skid and the blender dryer system is mounted on the third and fourth skids. The blender/dryer system is typically operated under vacuum conditions to improve heat transfer and reduce fouling of blender/dryer surfaces.

In the preferred operation of the reverse osmosis/filtration system, assuming aqueous waste 44 is of a typical constituency, a 50 gallon per minute (gpm) pump feeds aqueous waste 44 to a single-stage cartridge filter (prefilter) and microfilter that are aligned in series. The concentrate from the microfiltration is directed to the inlet of the blender dryer system. The permeate from the microfiltration is directed to the inlet of the reverse osmosis component. The concentrate from the reverse osmosis component is directed to the inlet of the blender dryer while the clean water permeates from the reverse osmosis component is reused or discharged. The blender dryer preferably comprises a steam heated evaporator/concentrator tank connected to a vacuum dryer. The water vapor from both the concentrator tank and the vacuum dryer is condensed and may be returned to the prefilter inlet for recycling. The dry product in the dryer is discharged to a waste drum or to the melt chamber.

The reverse osmosis/filtration system is designed for continuous operation with a 95% to 98% recovery rate of the feed water. It is possible to adjust the recycling of the microfiltration permeate and concentrate depending on the particular characteristics of aqueous waste 44. Typically, with a 50 gpm feed rate to the microfiltration and reverse osmosis stage of the system, approximately 0.5 to 1.0 gpm of concentrate will flow to the blender dryer. The remainder of aqueous waste 44 is clean and can be reused or discharged. The condensate can be reused also, thus providing close to 100% recovery of water if desired. However, because melter 26 can accommodate aqueous waste 44 having 5–20% by volume solids, such recovery rates are unnecessary.

Waste from feed conditioning subsystem 22, whether in the form of shredded DAW 38, dried resins and sludges 42 or concentrated aqueous waste 44, is transported to waste preparation subsystem 24 for blending with glass formers and possibly other wastes to form a waste feed stream for melter chamber 26. Waste preparation subsystem 24 is shown in FIGS. *2a–2b* and described below in more detail.

Melter chamber 26 converts the waste feed stream into molten glass and off-gas, as shown in FIGS. 3–4 and described below in more detail. The molten glass passes to glass handling subsystem 28, which is described in more detail below. Similarly, the off-gas passes to exhaust control component 32 and eventually pollution control component 34 of the off-gas cleaning and control subsystem, which is shown in FIGS. *5a–5b* and discussed more fully below.

In FIGS. *2a–2b*, portions of feed conditioning subsystem 22 and waste preparation subsystem 24 are shown schematically. Waste preparation subsystem 24 is used for mixing and blending all forms of waste discussed above and for delivering a consistent waste feed stream to melter chamber 26.

Waste preparation subsystem 24 preferably comprises a hydraulic shredder/classifier 54 fed by a conveyor 56 through an air lock 58, a main rotary screw melter feeder 62, a resin hopper 64 with a first metering auger 66, and a glass former hopper 68 with a second metering auger 72. First and second metering augers 66, 72 are used to blend resins and sludges 42 from resin hopper 64 and glass formers from glass former hopper 68 together with the shredded waste from shredder/classifier 54 for feeding directly into melter chamber 26 (shown in FIG. 1).

Shredder/classifier 54 is preferably similar to feed conditioning shredder 46, as shown in FIG. 1, and can be used in lieu of feed conditioning shredder 46 in most instances. The shredding portion of shredder/classifier 54 is an integrated material processor capable of processing drums, bales, concrete blocks, liquids, loose waste and the like. The classifier portion (not shown) of shredder/classifier 54 removes large metallic objects from shredder/classifier 54 that could possibly damage the overall feeding system of shredder/classifier 54.

Shredder/classifier 54 is operated in a facility under a negative pressure with a chemically inert gas or nitrogen blanket to reduce the threat of fire caused by high volume shredding by shredder/classifier 54 of certain products in DAW 38. Nitrogen can be supplied by external means, but is preferably extracted from off-gas from melter chamber 26, the operation of which is discussed more fully below.

Since the shredding portion of shredder/classifier 54 (and ultimately melter chamber 26) can process many metal objects, concrete, sand and other noncombustibles, the classifier portion of shredder/classifier 54 removes objects that cannot be processed by the shredding portion of shredder/classifier 54 such as thick steel plate, motors, valves and the like.

Although shredder/classifier 54 is used mainly for shredding DAW 38, liquid waste and/or aqueous waste 44 can be mixed with an adsorbent, packaged and fed into shredder/classifier 54 by conveyor 56 or some other appropriate means. Also, dried resins and sludges 42 can be packaged and fed into shredder/classifier 54 via conveyor 56. Thus, in this manner, shredder/classifier 54 can be used to begin blending all waste types together for feeding to melter chamber 26.

In the preferred operation of shredder/classifier 54, a plurality of waste drums 74 is loaded sequentially onto conveyor 56 by appropriate means. Drums 74 may contain compacted DAW 38, dried resins and sludges 42, aqueous liquid adsorbents and the like. As the first of waste drums 74 approaches air lock 58, an inner door 76 of air lock 58 closes and seals, air lock 58 is purged preferably with nitrogen, an outer door 78 of air lock 58 opens, a second conveyor 82 brings the drum into air lock 58, and then outer door 78 of air lock 58 closes and seals. Once outer door 78 of air lock 58 is closed and sealed and air lock 58 is purged, inner door 76 of air lock 58 opens. Second conveyor 82 then loads the drum onto an elevator (not shown) within air lock 58 that drops the drum into shredder/classifier 54.

Once waste drums 74 have passed the classifier portion and are in the shredding portion of shredder/classifier 54, the waste contained in waste drums 74, as well as waste drums 74 themselves, are reduced to pieces preferably approximately 7.50 cm×7.50 cm. The contents of the waste at this time is normally composed substantially of DAW 38, however, it may also contain aqueous waste 44, adsorbents containing aqueous waste 44, concentrated aqueous waste 44, resins and sludges 42 and the like.

Upon completion of shredding and, to a certain extent mixing, the contents of shredder/classifier 54 are fed into main rotary screw melter feeder 62, which pushes the waste material into melter chamber 26. As the shredded waste material from shredder/classifier 54 moves through main rotary screw melter feeder 62 toward melter chamber 26, resins and sludges 42 from resin hopper 64 are preferably blended together therewith using first metering auger 66. Similarly, glass formers from glass former hopper 68 are also released into second metering auger 72 to blend in rotary screw melter feeder 62 with shredded waste material from shredder/classifier 54.

The mixing rate and overall composition of the waste being fed into melter chamber 26 can be adjusted depending on the composition of the wastes being blended together and the ultimate feed composition desired. Blending several waste types together prior to entry into melter chamber 26 produces a more consistent melter feed, thus eliminating potential thermal spikes within melter chamber 26 and off-gas emissions in off-gas control component 32 and pollution control component 34 and allowing more efficient operation of melter chamber 26. Also, different waste types can be stored temporarily until desirable blending ratios are possible. This is useful for batch processing operations, especially in view of pending legislation that may require processed waste to be returned, curie-for-curie to the plant from which it came.

In FIG. 3, a schematic view of the preferred embodiment of the melter/combustion subsystem and glass handling subsystem 28 (both shown generally in FIG. 1) of waste processing system 20 is shown. The melter/-combustion subsystem preferably comprises a two-zone melter chamber 26 having an upper or thermal zone 84, a lower or melting zone 86 and a disconnect mechanism 87.

Upper or thermal zone 84 is where the bulk of the volume reduction and off-gas separation of entering waste occurs. Lower zone 86, which houses a melter chamber 88 heated by electric induction heating coils 92, is where waste and glass formers are melted together to form a glassy pool.

Both upper zone 84 and lower zone 86 are preferably cylindrical water-cooled vessels with inner and outer liners. However, other forms of cooling and liners made of several suitable materials can be used. For example, chamber 88 could have a silicon carbide, inconel, alumina or zirconia liner. Also, upper zone 84 can be lined with a removable metal radiation barrier or with optional refractory material; lower zone 86 is not lined.

Lower zone 86 is adapted for use with disconnect mechanism 87 and can comprise any one of a number of known melting zone designs, including refractory lined, Joule heated electrode melters; induction heated cold wall crucibles; induction heated warm or hot wall crucibles; in-can melter chambers; and slagging chambers.

Cold wall crucibles feature a segmented wall, preferably made of non-suscepting Inconel, cooled by a surrounding water wall. Also, the crucible has a water jacket (or cold wall) "disc" bottom and induction heating coils surrounding the crucible and water wall that operate within the frequency range of approximately 30–50 kHz.

Warm and hot wall crucibles feature a cylindrical crucible with a cold wall bottom. Typically, warm wall crucibles are made of non-suscepting alumina or zirconia, although a suscepting crucible liner is optional. Hot wall crucibles are made of silicon carbide or Inconel. The induction heating coils normally operate in the range of approximately 30–50 kHz for warm wall crucibles and 1–3 kHz for hot wall crucibles.

In-can melter chambers are cylindrical canisters with an optional refractory lining. The canisters are surrounded by induction heating coils or a resistive heating element. Slagging chambers use the buildup of glass on the inside of the chamber walls to restrict heat loss that, along with water cooled walls, eliminate the need for refractory lining and controls the temperature of the chamber by removing heat quickly.

Preferably, the top of upper zone 84 has a plurality of pipes, shown generally as 94, 96, attached thereto for air, oxygen and water feeds, instrumentation, camera view ports and the like. Also, a larger pipe 98 is attached to the top of upper zone 84 for gas recirculation (discussed in greater detail below). Waste is fed into upper zone 84 via rotary screw melter feeder 62 (shown in FIGS. *2a–2b*) through a first side port 102. A second side port 104 is a gas outlet port connecting melter chamber 26 with the off-gas cleaning and control subsystem.

Waste fed into melter chamber 26 from shredder/-classifier 54 of waste preparation subsystem 24 (see FIGS. 1, *2a–2b*) falls onto the molten glass pool within melt chamber 88 formed by glass formers, noncombustible waste and ash from combustible waste. Organic constituents present in the waste are consumed by the intense heat maintained within thermal zone 84 and burned off. Combustibles within the waste become off-gas, which passes through outlet port 104, and ash, which dissolves into the molten glass pool in chamber 88. The non-organic constituents in the waste also dissolve or settle into glass thereby becoming incorporated into the glass melt.

Alternatively, aqueous waste 44 can be fed directly into melter chamber 26 without prior conditioning or blending with other types of waste. Similarly, resins and sludges 42 and adsorbents containing resins and sludges 42 or liquid waste can be fed directly into melter chamber 26 without affecting greatly the final glass product produced.

Controlled amounts of oxygen, preferably mixtures containing approximately 20–90% oxygen, are injected into melter chamber 26 through one of the pipes 94, 96 to aid in processing and volume reduction of the contents of reciter chamber 26. The high oxygen content minimizes the off-gas volume and improves oxidation kinetics in melter chamber 26, thus greatly reducing nitrogen in the off-gas. Off-gas formed in melter chamber 26 is exhausted through second port 104, which passes to exhaust control component 32 of the off-gas cleaning and control subsystem (discussed in greater detail below). Alternatively, an immersion thermocouple (not shown) can be used to verify the maintenance of off-gas and refractory temperatures in melter chamber 26. A bottom induction nozzle 106 taps molten glass produced in melter chamber 26, preferably cooling the molten glass during tapping to stop flow as required. From nozzle 106, the molten glass proceeds to glass handling subsystem 28.

Preferably, remote power supplies (not shown) provide approximately 400 kw of power at approximately 1–50 kHz to induction coils 92 through a lower port 107. Generally, 1–3 kHz is used for hot wall induction heating and in-can melter applications and approximately 30–50 kHz for warm and cold wall induction heated applications (both discussed above). The heat generated by induction heating melts and ultimately vitrifies the glass formers with the noncombustible waste contents and ash that have been fed into melter chamber 26. Induction heating provides much more efficient heating and stirring than conventional vitrification heating applications using electrodes. As a result, the consistency and homogeneity of the molten glass matrix and ultimately the final glass product is improved.

The consistency of the final glass product is typically measured by the leach and solubility characteristics of the final glass composite. That is, when vitrified, metals in the waste contents dissolve in the glass in the form of metal oxides rather than the glass encapsulating the metal particles. The use of enriched oxygen (discussed below) enhances oxidation of metals to oxides thereby improving incorporation of metals into a glass matrix.

A particulate filter 108 is remotely loaded in front of second port 104 to minimize particulate matter formed in thermal zone 84 from passing to the off-gas cleaning and control subsystem. Filter 108 also serves as a radiant heat barrier for thermal zone 84. Preferably, the differential pressure across filter 108 is monitored and, as the pressure increases—indicating that cleaning or replacement is necessary—filter 108 can be back flushed with gas to clean filter 108 or, alternatively, filter 108 can be pushed into melter chamber 26 and a new filter can be loaded.

Glass handling subsystem 28 receives, solidifies and packages the stabilized liquid glass waste for eventual transport. Preferably, a portion of glass handling subsystem 28 includes a sealed enclosure 112 positioned under melt chamber 26 and nozzle 106. Enclosure 112 is dimensioned to house a bulk storage canister 114 that is to be filled with molten glass tapped from nozzle 106. Once canister 114 is filled with molten glass, it is cooled, capped and washed within enclosure 112. Canister 114 is then removed for positioning of the next canister to be filled.

In FIG. 4, a schematic view of an alternative embodiment of melter/combustion subsystem and glass handling subsystem 28 (both shown generally in FIG. 1) of waste processing system 20 is shown. In this alternative embodiment, molten glass is tapped from nozzle 106 directly into a water-cooled glass solidification unit 116 where the glass is cooled into globules that can then be handled like marbles for ease of storage and handling.

Solidification unit 116 is preferably a cooled, metal conveyor 118 that moves molten glass tapped from nozzle 106 to a waste glass hold-up bin 122 while simultaneously cooling the molten glass. Preferably, water is used as the cooling liquid and sprays on the bottom side of metal conveyor 118 and, optionally, as a mist on top of conveyor 118 through spray jets 123. With this relatively rapid solidification, the molten glass forms small, solid globules.

In this embodiment, by the time the molten glass reaches the end of liquid-cooled conveyor 118, the glass will be fully solidified and cooled to less than approximately 250° C. The glass globules will fall into holding bin 122 through a tube 124 connecting liquid-cooled conveyor 118 to holding bin 122. A waste glass fill chamber 126, which is sealed against an outlet 128 of holding bin 122, houses a waste container 132 for filling with the glass marbles as required. Preferably, any fine glass particulates exiting liquid-cooled conveyor 118 will be returned to melt chamber 26 by appropriate means. The alternative embodiment shown in FIG. 4 allows the glass globules to be stored in a wide variety of container sizes and shapes without the need for complex fill port arrangements. This is advantageous, particularly in the United States, because the glass marbles produced can be directly placed in high density, cross-linked polyethylene containers or other appropriate containers for final disposal.

Figure 5A:
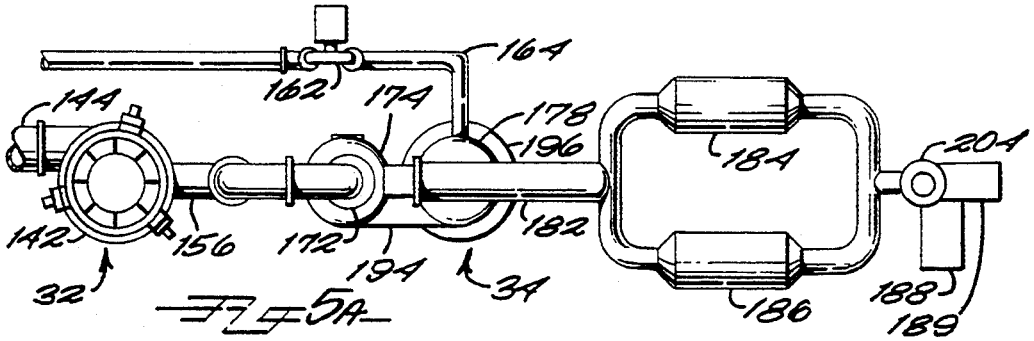
Figure 5B:
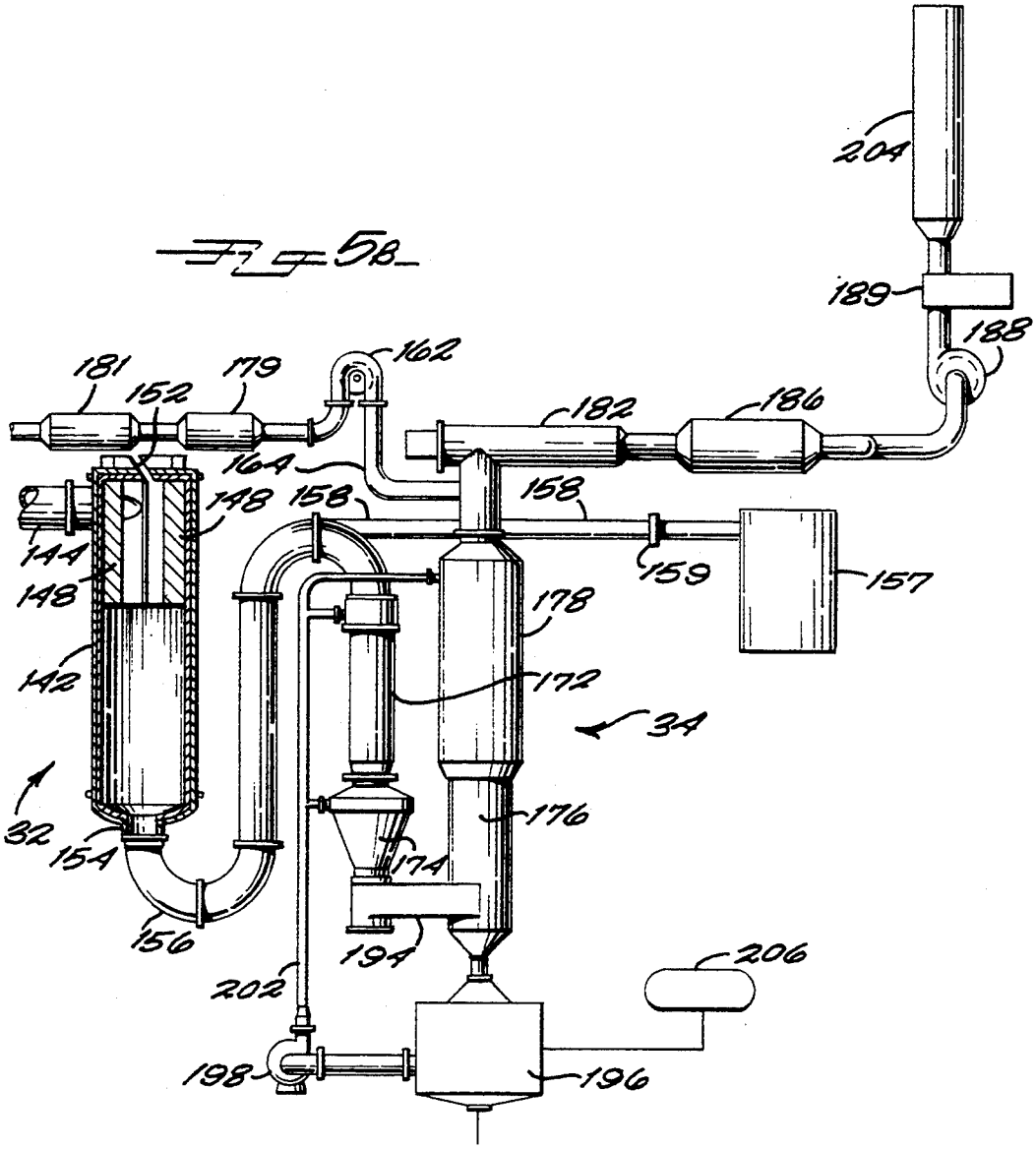

FIGS. 5*a*–5*b* show the off-gas cleaning and control subsystem, that is also shown diagrammatically in FIG. 1. As mentioned previously, the off-gas cleaning and control subsystem has an exhaust control component 32 and a pollution control component 34.

Exhaust control component 32 is preferably a carbon monoxide control chamber 142 for oxidizing volatile organics and vapor products to carbon dioxide and water. Control chamber 142 is preferably a cylindrical, vertically-oriented vessel constructed with an inconel or other alloy inner shell lined with a high temperature refractory designed for long-term operation. The refractory can be a remotely applied, gunite cement that eliminates manual replacement of refractory.

Control chamber 142 has an inlet port 144 in connection with outlet port 104 of melter chamber 26 for receiving off-gas therefrom. Inlet port 144 is preferably oriented so that off-gas enters control chamber 142 at an angle to increase gas flow and mixture. Also, control chamber 142 has mounted around its upper area a plurality of electrical resistance heaters 148 for keeping control chamber 142 at proper operating temperatures. Preferably, resistance heaters 148 are rated at a total power of approximately 160 kw.

Control chamber 142 is designed to provide high turbulence, preferably greater than a Reynolds number of approximately 8,000 for off-gas having a residence time of approximately 2–3 seconds with a temperature of 1000°–1200° C. Such turbulence is preferably sufficient to completely oxidize organics in the off-gas from melter chamber 26.

An injection port 152, shown in FIG. 5*b*, tangentially penetrates control chamber 142 for injecting an air/oxygen mixture at an angle to increase mixing of the gas and to assist in the conversion of carbon monoxide to carbon dioxide and water. An air/oxygen mixture is used instead of air alone to reduce the gas volume and formation of $NO_x$, both of which would be higher if air alone were used since air is approximately 78% nitrogen.

Also, an outlet port 154 located at the bottom of control chamber 142 connects to ductwork 156, which directs off-gas from control chamber 142 forward to pollution control component (shown generally as 34) of the off-gas cleaning and control subsystem.

Prior to pollution control component 34, a pressure control and containment system is connected to ductwork 156. The pressure control and containment system preferably comprises an overpressure control chamber 157 connected to ductwork 156 through piping 158 and an overpressure control device 159.

The pressure control and containment system is used for capturing releases by the entire waste processing system 20 due to large pressure spikes, thus preventing uncontrolled releases to the environment. Overpressure control chamber 157 is preferably an expansion tank for containing vented gases during excessive overpressure conditions. Also, overpressure control chamber 157 may contain water spray cooling devices (not shown) to assist in cooling gases released into chamber 157.

Overpressure control device 159 is used to separate overpressure control chamber 157 from ductwork 156 and the normal operation of waste processing system 20, and usually in the form of a burst disk that connects overpressure control chamber 157 to ductwork 156 when an excessive overpressure condition forms within waste processing system 20. Also, the pressure control and containment system contains emergency exhaust (not shown) in case of explosion, backfire or flareup.

Pollution control component 34 of the off-gas cleaning and control subsystem can include any of a number of elements but the specific configuration of pollution control component 34 will depend on factors such as emissions regulations, locality, public opinion and cost. The ability to properly clean off-gas from melter chamber 26 is required not only to license and legally operate systems such as the waste processing system 20, but also to protect public health and the environment.

Preferably, a wet scrubbing pollution control component 34 is used in the off-gas cleaning and control subsystem of waste processing system 20. Such a configuration preferably contains a gas quencher 172, a venturi scrubber 174, a cyclone mist separator 176, a packed bed scrubber 178, an electric heater 182, a pair of HEPA filters 184 and 186, and an induced draft fan 188. One advantage of a wet scrubbing configuration is the high removal efficiency for particulate metals and acid gases such as $SO_x$, HCl and HF. Another advantage is that particulates in the off-gas are intercepted by water droplets in venturi scrubber 174 and contained in the scrubbing liquid. Thus, the particulates are not produced as fly ash.

Gas quencher 172 connects to ductwork 156 from control chamber 142 and is the first element of pollution control component 34. Gases exiting control chamber 142 potentially contain a variety of gases and vaporized metals that require treatment and/or removal prior to release to the atmosphere. Such pollutants include CO, $SO_2$, $SO_3$, $NO_x$, HCl, HF, $HBr_2$, heavy metals and radioisotopes (in particular $C_{14}$, $H_3$, and Cesium).

Gas quencher 172 rapidly cools passing off-gas by injecting a solution of sodium hydroxide and water into the off-gas. The water mist initially absorbs the sensible heat and then absorbs latent heat as it is vaporized. By rapidly cooling the off-gas, gas quencher 172 reduces the possibility of downstream components being damaged by excessive heat. Secondly, gas quencher 172 reduces the gas load by a factor of 3—cool gas occupies less space than hot gas—thus reducing the necessary size of downstream components. Also, gas quencher 172 decreases any potential formations of Dioxins and Furans since the off-gas does not remain in gas quencher 172 long enough nor is the temperature range (approximately 200°-300° F.) appropriate for their formation. Finally, gas quencher 172 causes the initiation of particulate and acid gas absorption.

Venturi scrubber 174 is used to remove both particulates and acid gases from the off-gas stream at very high efficiencies. Venturi scrubber 174 has a converging section, a throat section and an expansion section. In operation, gases are accelerated in the converging section and pass through the throat section where the scrubbing liquid solution is injected. As the gas passes through the throat and expansion sections, the sudden expansion atomizes the scrubbing liquid thereby providing a large surface area for the collection of particulate and acid gases.

The wet, mist-laden gas from venturi scrubber 174 enters cyclone mist separator 176 tangentially through a horizontal tangential inlet 194. The cyclonic entrainment uses inlet 194 to induce a centrifugal force on the entering gases. Liquid drops are forced to the internal walls of separator 176 where the drops coalesce and drain into a collection sump 196. From collection sump 196, the coalesced liquid is preferably recirculated back to gas quencher 172 via a scrubber pump 198 and piping 202. Alternatively, the scrubber liquid is directed to a volume reduction system (not shown) such as the blender/dryer system described above. Unlike the liquid drops, the mist-free gases exit cyclone mist separator 176 and enter packed bed scrubber 178.

Packed bed scrubber 178 removes acid gas at high efficiencies. In operation, the entering gas stream flows through a nonmetallic packing material that provides a high wetted surface area. A scrubbing solution is injected counter-currently to the gas stream, that is, down through a packed bed. The scrubbing solution, which is preferably a water solution adjusted with sodium hydroxide to a pH of approximately 6-8, drips down through the packed bed and fully wets all the available surface area. As the gas stream flows up through the packed bed, the particulates and acid gases from the gas stream impinge on the wetted packing and are absorbed and neutralized by the scrubber liquid. The scrubbing solution then drains down through the cyclone mist separator 176 and into collection sump 196.

Approximately 50-150% of the stack off-gas is recycled using a blower unit 162 contained within a segment of recycling pipe 164 in connection with the rear end of pollution control component 34. Since 90% oxygen is injected into reciter chamber 26 (see pipes 96, 98 in FIGS. 3-4 and related discussion above) to greatly reduce nitrogen, a portion of the off-gas produced in melter chamber 26 can be recycled after passing through packed bed scrubber 178.

A carbon dioxide removal unit 179 and a nitrogen removal unit 181 can be installed along recycling pipe 164 after blower unit 162. In this configuration, carbon dioxide removal unit can be any known removal unit suitable for this application but is preferably a liquification/refrigeration unit or an adsorber/scrubber unit. Similarly, nitrogen removal unit 181 can be any suitable unit but is preferably a nitrogen removal adsorber.

Heater 182, preferably an electric resistance heater rated at approximately 50 kw, can be placed between packed bed scrubber 178 and filters 184, 186 for reducing the humidity of the gas as required for efficient operation of HEPA filters 184 and 186. Also, heater 182 could be sized to suppress the stack plume as desired, that is, to reduce the water vapor plume of the stack gas. Such reduction may be driven by public sensitivity to stack plumes.

HEPA filters 184 and 186 are preferably high efficiency particulate absorbing filters capable of removing particles approximately 0.30 micrometers and larger at approximately 99.97% efficiency. The filter cartridge (not shown) for HEPA filters 184 and 186 is preferably a glass fiber media. Preferably, filter housings facilitate removal of the filter cartridge so that nothing is released to the environment.

Preferably, HEPA filters 184 and 186 are configured in parallel so that pollution control component 34 remains in operation while either one of filters 184, 186 is being changed out. Filters 184, 186 can be housed in a stainless steel housing (not shown) along with pre-filters and the like as necessary.

Induced draft fan 188, preferably a centrifugal, radial blade fan, is positioned just before a plurality of Continuous Emission Monitors 189 and an emission stack 204. Induced draft fan 188 is used to pull gas through the off-gas cleaning and control subsystem and to maintain a negative pressure inside melter chamber 26 in the range of approximately −2.9 to −4.9 KPa.

Alternatively, carbon dioxide removal unit 179 and nitrogen removal unit 181 can be used downstream of HEPA filters 184 and 186 for removal of carbon dioxide and nitrogen thereby leaving almost no stack emissions.

Preferably, collection sump 196 is a scrubbing liquid recirculation system, similar to a closed water cooling system. Collection sump 196 has a tank, dual pumps, filters, a heat exchanger and various piping and valves (none of which are shown). Collection sump 196 differs from a closed water cooling system in that the tank is a holding tank acting as a sump for the removal of sludge returned from the scrubber 178.

Also, incorporated into the collection sump 196 is a scrubber-solution, pH adjustment subsystem (not shown) with dual metering pumps and a controller. Preferably, this subsystem continuously monitors and adjusts the pH of the scrubber solution between approximately 6-8 by the addition of sodium hydroxide, shown generally as 206, or other suitable substance. Also, fresh make-up water can be added as required. Normally, scrubber sludge is comprised principally of NaCl from neutralized HCl (from PVC plastics) and $Na_2SO_4$ from neutralization of $SO_x$ from cation ion exchange resins.

In use, waste processing system 20 vitrifies radioactive waste, comprised essentially of DAW 38, resins and sludges 42 and aqueous waste 44, that is generated by plant 36 and conditioned and blended with glass formers for vitrification. DAW 38 is conditioned by shredding. Resins and sludges 42 are conditioned by drying of interstitial, "free" water. Aqueous waste 44 is conditioned by concentration using filtration, adsorbents, and dryers so that aqueous waste 44 is approximately 5–90% by volume solids, but usually 70–90% by volume solids.

Preferably, the DAW and conditioned resin and aqueous wastes are packaged in suitable containers and transported off-site to a centralized facility that houses waste preparation subsystem 24, the melting combustion subsystem, glass handling subsystem 28 and the off-gas cleaning and control subsystem. Resins and sludges 42 are then placed in hopper 64 and the remaining waste is fed into shredder/classifier 54. Alternatively, some of the waste can be fed directly into melter chamber 26 depending on its constituency.

Then, all of the waste types are blended together depending on their particular constituents to produce a waste feed stream that will yield a constant BTU value when combusted. Shredder/classifier 54 and feeder 62 can be used to assist in blending the waste types, as can hoppers 64, 68.

Once waste feed is fed into melter chamber 26, either continuously or in a batch mode, the combustible constituents of the waste feed are combusted in upper zone 84 and lower zone 86 to form an off-gas and an ash. The ash settles or dissolves along with the noncombustible constituents of the waste feed and the glass formers into the glass matrix. The ash, noncombustibles and the glass formers melt together to form a molten glass matrix using chamber 88.

The molten glass matrix is dispensed to glass handling subsystem 28, where it is stored in suitable containers for solidification. The molten glass can be cooled as small blocks or large monoliths, depending on the size and shape of the storage containers, which can be high integrity containers or other suitable packages. Also, the molten glass can be cooled in the shape of marbles or crushed into a frit for storage in containers of various sizes and shapes.

The off-gas produced in thermal zone 84 of melter 26 is processed through the off-gas cleaning and control subsystem, where it cleaned, partially recycled and eventually passed through a filtered emissions stack 204 into the environment.

It will be apparent to those skilled in the art that the present invention is applicable to the processing of all types of waste, including but not limited to radioactive, toxic, industrial, household and the like, and that the examples discussed herein above are exemplary only.

It will be apparent to those skilled in the art that many changes and substitutions can be made to the preferred embodiment herein described without departing from the spirit and scope of the present invention as defined by the appended claims.

What is claimed is:

1. Apparatus for encapsulating in glass a plurality of kinds of radioactive waste, said plurality of kinds of radioactive waste having combustible constituents and noncombustible constituents, said each kind of said plurality of kinds of radioactive waste having a heat energy value, said apparatus comprising:

means for producing a waste mixture from at least one kind of said plurality of kinds of radioactive waste, wherein said means for producing a waste mixture forms a waste mixture with a heat energy value within a preselected range;

means for mixing said waste mixture with at least one glass former to form a feed mixture; and means for heating said feed mixture so that said combustible constituents of said plurality of kinds of radioactive waste of said waste mixture burn to form an ash and an off-gas, and said glass formers melt, and said noncombustible constituents of said plurality of kinds of radioactive waste and said ash combine with said molten glass formers to form a molten waste glass, so that, when said molten waste glass cools, said radioactive waste is encapsulated in said waste glass.

2. The apparatus as recited in claim 1, wherein said wastes comprise at least one kind of waste selected from the group consisting of dry active waste, resin waste and aqueous waste, and wherein said producing means further comprises means for concentrating a solids content of said aqueous waste to not more than 20% by volume.

3. The apparatus as recited in claim 1, wherein said wastes comprise at least one kind of waste selected from the group consisting of dry active waste, resin waste and aqueous waste, and wherein said producing means further comprises:

means for shredding said dry active waste;

means for drying said resin waste;

means for concentrating a solids content of said aqueous waste to at least 5% by volume; and means for blending said at least one kind of said waste to form said waste mixture.

4. The apparatus as recited in claim 1, wherein said heating means further comprises:

a melter chamber; and means for inductively heating said feed mixture when said feed mixture is in said melter chamber.

5. The apparatus as recited in claim 1, wherein said heating means further comprises a melter chamber having an upper area for combustion of said combustible constituents and a lower area for melting said glass formers with said noncombustible constituents and said ash.

6. The apparatus as recited in claim 1, wherein said heating means further comprises:

a melter chamber having a thermal zone for combusting said combustible constituents, a melter crucible releasably carried by said melter chamber, and a disconnect mechanism mounted on said melter chamber for releasably carrying said melter crucible.

7. The apparatus as recited in claim 1, further comprising means for cooling said molten waste glass.

8. The apparatus as recited in claim 1, further comprising:

means for cooling said molten waste glass, said cooling means shaping said waste glass into a form for storage in a container, said form selected from the group comprising frit, globules and monoliths.

9. The apparatus as recited in claim 1, wherein said off-gas includes particulates and wherein said apparatus further includes an off-gas stack in fluid communication with said heating means and through which said off-gas can flow; and means carried by said off-gas stack for removing said particulates from said off-gas.

10. The apparatus as recited in claim 1, wherein said off-gas has particulates and wherein said apparatus further comprises:

an off-gas stack in fluid communication with said heating means and through which said off-gas can flow;

means carried by said off-gas stack for removing said particulates from said off-gas; and means connected to said off-gas stack downstream from said removing means for recycling a portion of said off-gas to said heating means.

11. The apparatus as recited in claim 10, wherein said recycling means further comprises means for removing carbon dioxide from said off-gas being recycled and means for removing nitrogen from said off-gas being recycled.

12. The apparatus as recited in claim 10, wherein said removing means further comprises means for removing nitrogen from said off-gas.

13. The apparatus as recited in claim 1, wherein said radioactive wastes comprise at least one kind of waste is selected from the group consisting of dry active waste, resin waste and aqueous waste, and wherein said producing means further comprises:

means for shredding said dry active waste;

means for drying said resin waste; and means for blending said at least one kind of said radioactive waste to form said waste mixture.

14. The apparatus as recited in claim 1, further comprising means for cooling said molten waste glass, and wherein said heating means further comprises:

a melter chamber; and means for inductively heating said feed mixture when said feed mixture is in said melter chamber.

15. The apparatus as recited in claim 1, wherein said heating means further comprises a reciter chamber having an upper area for combustion of said combustible constituents and a lower area for melting said glass formers with said noncombustible constituents and said ash, and further comprising means for cooling said molten waste glass.

16. The apparatus as recited in claim 1, further comprising means for cooling said molten waste glass and wherein said heating means further comprises:

a melter chamber having a thermal zone for combusting said combustible constituents, a melter crucible releasably carried by said melter chamber, and a disconnect mechanism mounted on said melter chamber for releasably carrying said melter crucible.

17. An apparatus for encapsulating radioactive waste, said radioactive waste selected from the group consisting of dry active waste, ion exchange resin, and aqueous wastes, said apparatus comprising:

means for producing a feed mixture made from said radioactive wastes and glass formers, wherein said means for producing said feed mixture forms said feed mixture having a heat energy value within a preselected range;

means for generating a combustion gas having excess oxygen; and means in fluid communication with said generating means for heating said feed mixture in the presence of said combustion gas; and means for feeding said feed mixture to said heating means.

18. The apparatus as recited in claim 17, further comprising:

an off-gas stack in fluid communication with said heating means, said waste mixture burning in said heating means to produce an off-gas; and means carried by said off-gas stack for recycling a portion of said off-gas to said generating means.

19. The apparatus as recited in claim 17, further comprising:

an off-gas stack in fluid communication with said heating means, said waste mixture burning in said heating means to produce an off-gas, said off-gas containing particulates;

means carried by said off-gas stack for removing said particulates from said off-gas and returning said particulates to said heating means; and means carried by said off-gas stack downstream of said removing means for recycling a portion of said off gas to said generating means.

20. The apparatus as recited in claim 17, wherein said heating means further comprises:

a crucible; and means for inductively heating said waste feed when in said crucible.

21. The apparatus as recited in claim 17, wherein said heating means further comprises:

a heating chamber having an upper thermal zone and a lower melting zone;

a crucible in said melting zone; and a liner in said crucible, said crucible and said liner being carried within said heating chamber so that said crucible can be detached from said-heating chamber to replace said liner and said crucible.

22. The apparatus as recited in claim 17, wherein said generating means generates said combustion gas from air, enriching a volume of air in oxygen and removing a portion of nitrogen from said volume of air, said generating means feeding said portion of nitrogen to said producing means to blanket said radioactive waste.

23. The apparatus as recited in claim 17, wherein said radioactive aqueous waste has a solids component, and wherein said producing means further comprises means for concentrating said radioactive aqueous waste to not more than approximately 20% by volume.

24. The apparatus as recited in claim 17, further comprising means for venting gases formed within said apparatus during excessive overpressure conditions.

25. The apparatus as recited in claim 17, wherein said generating means includes means for radially directing said combustion gas having excess oxygen into said heating means.

26. The apparatus as recited in claim 17, wherein said heating means further comprises a crucible, and means for inductively heating said waste feed when in said crucible and further comprising an off-gas stack in fluid communication with said heating means, said waste mixture burning in said heating means to produce an off-gas; and means carried by said off-gas; stack for recycling a portion of said off gas to said generating means.

27. The apparatus as recited in claim 17, wherein said producing means further comprises:

means for shredding said dry active waste;

means for drying said resin waste; and means for concentrating a solid content of said aqueous waste to at least 5% volume.

* * * * *